US008888903B2

(12) United States Patent
Hirsekorn et al.

(10) Patent No.: US 8,888,903 B2
(45) Date of Patent: Nov. 18, 2014

(54) ELECTROLESS PALLADIUM PLATING BATH COMPOSITION

(75) Inventors: Isabel-Roda Hirsekorn, Paulinenaue (DE); Jens Wegricht, Berlin (DE); Arnd Kilian, Berlin (DE)

(73) Assignee: Atotech Deutschland GmbH, Berlin (DE)

( * ) Notice: Subject to any disclaimer, the term of this patent is extended or adjusted under 35 U.S.C. 154(b) by 0 days.

(21) Appl. No.: 14/351,148

(22) PCT Filed: Aug. 22, 2012

(86) PCT No.: PCT/EP2012/066358

§ 371 (c)(1), (2), (4) Date: Apr. 11, 2014

(87) PCT Pub. No.: WO2013/053518

PCT Pub. Date: Apr. 18, 2013

(65) Prior Publication Data

US 2014/0242265 A1 Aug. 28, 2014

(30) Foreign Application Priority Data

Oct. 12, 2011 (EP) ..... 11184919

(51) Int. Cl.
*C23C 18/44* (2006.01)
*C23C 18/16* (2006.01)

(52) U.S. Cl.
CPC ..... *C23C 18/44* (2013.01); *C23C 18/1637* (2013.01)
USPC ..... 106/1.24; 106/1.28

(58) Field of Classification Search
CPC ..... C23C 18/1637; C23C 18/44
USPC ..... 106/1.24, 1.28; 427/99.5, 437, 443.1
See application file for complete search history.

(56) References Cited

U.S. PATENT DOCUMENTS

| | | | | |
|---|---|---|---|---|
| 4,341,846 | A * | 7/1982 | Hough et al. | 428/670 |
| 4,804,410 | A * | 2/1989 | Haga et al. | 106/1.28 |
| 5,882,736 | A | 3/1999 | Stein et al. | |
| 7,704,307 | B2 * | 4/2010 | Aiba et al. | 106/1.24 |
| 7,981,202 | B2 * | 7/2011 | Kojima et al. | 106/1.24 |
| 8,562,727 | B2 * | 10/2013 | Watanabe et al. | 106/1.24 |
| 2009/0081369 | A1 | 3/2009 | Aiba et al. | |

FOREIGN PATENT DOCUMENTS

| | | |
|---|---|---|
| EP | 0757121 | 2/1997 |
| GB | 2034756 | 6/1980 |
| JP | 2005-248192 | 9/2005 |

OTHER PUBLICATIONS

Database WPI Week 200563; Thomson Scientific, London, GB; AN 2005-611257; XP002669553, & JP 2005 248192 A (ASAHI ENG co LTD); Sep. 15, 2005 abstract.
PCT/EP2012/066358; PCT International Search Report and Written Opinion of the International Searching Authority dated Dec. 19, 2013.
PCT/EP2012/066358; PCT International Preliminary Report on Patentability mailed Jun. 2, 2014.

* cited by examiner

*Primary Examiner* — Helene Klemanski
(74) *Attorney, Agent, or Firm* — Renner, Otto, Boisselle & Sklar, LLP

(57) ABSTRACT

The present invention concerns an aqueous plating bath composition for electroless deposition of palladium and/or palladium alloys and a method which utilises such aqueous plating bath compositions. The aqueous plating bath comprises a source of palladium ions, a reducing agent, a nitrogenated complexing agent which is free of phosphorous and at least one organic stabilising agent comprising 1 to 5 phosphonate residues. The aqueous plating bath and the method are particularly useful if the aqueous plating bath comprises copper ions.

19 Claims, No Drawings

ELECTROLESS PALLADIUM PLATING BATH COMPOSITION

The present application is a U.S. National Stage Application based on and claiming benefit and priority under 35 U.S.C. §371 of International Application No. PCT/EP2012/066358, filed 22 Aug. 2012, which in turn claims benefit of and priority to European Application No. 11184919.6, filed 12 Oct. 2011, the entirety of each of which is hereby incorporated herein by reference.

FIELD OF THE INVENTION

The present invention relates to plating bath compositions and a method for electroless deposition of palladium and palladium alloys in the manufacture of printed circuit boards, IC substrates and semiconductor devices.

BACKGROUND OF THE INVENTION

Electroless deposition of palladium and palladium alloys in the manufacture of printed circuit boards, IC substrates and the like as well as metallisation of semiconductor wafers is an established technique. The palladium or palladium alloy layers are used as barrier layers and/or wire-bondable and solderable finishes.

The type of palladium deposit (pure palladium or palladium alloy) derived by electroless plating depends on the reducing agent employed.

Formic acid, derivatives and salts thereof result in pure palladium deposits. Phosphorous containing reducing agents such as sodium hypophosphite result in palladium-phosphorous alloys. Borane derivatives as reducing agent result in palladium-boron alloy deposits.

Electroless palladium plating bath compositions comprising a source of palladium ions, a nitrogenated complexing agent and a reducing agent selected from formic acid and derivatives thereof are disclosed in U.S. Pat. No. 5,882,736. Such electroless palladium plating bath compositions are suited to deposit pure palladium.

Electroless palladium plating bath compositions comprising a source of palladium ions, a complexing agent comprising phosphonate groups and a reducing agent selected from formaldehyde, a phosphate ion generator, a boron-nitrogen compound, a borohydride, or an alkylamine borane are disclosed in GB 2034 756 A. Such electroless palladium plating bath compositions are suited to deposit either pure palladium or palladium alloys with boron and/or phosphorous.

A plating bath composition for electroplating of palladium and palladium alloys comprising a palladium diamminodichloro complex, a nitrite salt as conductive salt and 1-hydroxy-ethane-1,1-diphosphonic acid is disclosed in EP 0 757 121 A1.

A plating bath composition for electroplating of palladium and palladium alloys containing palladium as the palladosammine chloride and an alkylene diamine phosphonate is disclosed in U.S. Pat. No. 4,066,517.

An electroless palladium plating bath composition comprising at least one of hypophosphorous acid, phosphorous acid, formic acid, acetic acid, hydrazine, a boron hydride compound, an amine borane compound, and salts thereof as a reducing agent is disclosed in US 2009/0081369 A1.

Palladium deposition from plating bath compositions according to U.S. Pat. No. 5,882,736 in the presence of copper ions in the plating bath is not possible (comparative examples 1).

Palladium and palladium alloys are deposited onto substrates having a metal surface on at least a portion of said substrates. Typical metal surfaces comprise copper, copper alloy, nickel and nickel alloy.

In case of printed circuit boards, IC substrates and the like as well as semiconductor wafers palladium and palladium alloy deposition is disturbed if the electroless plating bath contains copper ions. The plating rate of palladium or palladium alloy deposition is already strongly reduced at 5 ppm or even less copper ions present in the electroless plating bath. Copper ions may be dissolved from the substrate when immersed in an immersion-type palladium plating bath which is often used as an activation method for the metallic surface prior to palladium deposition from an electroless plating bath. In case the copper surface is not completely coated with a palladium layer in an activation step, copper ions are formed when contacting the copper surface of the substrate with an electroless plating bath for deposition of palladium and/or palladium alloys in the next step. During manufacture of electronic components such as printed circuit boards, IC substrates and metallisation of semiconductor wafers copper ions are then enriched in the electroless palladium and/or palladium alloy plating bath and first slow down and then stop palladium and/or palladium alloy deposition completely.

OBJECTIVE OF THE INVENTION

Therefore, it is the objective of the present invention to provide an aqueous electroless plating bath and a plating method which allows deposition of palladium and/or palladium alloys at a sufficient plating rate in the presence of copper ions in the electroless plating bath.

SUMMARY OF THE INVENTION

This objective is solved by an aqueous plating bath for electroless deposition of palladium and/or palladium alloys onto a metal surface, the plating bath comprising a. a source of palladium ions
b. at least one nitrogenated complexing agent which is free of phosphorous
c. a reducing agent and
d. at least one organic stabilising agent which comprises 1 to 5 phosphonate residues wherein the concentration of the stabilising agent which comprises 1 to 5 phosphonate residues ranges from 0.1 to 100 mmol/l for stabilising agents comprising four and five phosphonate residues and from 50 to 500 mmol/l for stabilising agents comprising one, two and three phosphonate residues.

A method for deposition of palladium and palladium alloys onto a metal surface according to the present invention comprises the steps of a. providing a substrate having a metal surface,
b. proving an aqueous palladium or palladium alloy plating bath comprising a source of palladium ions, a reducing agent, a nitrogenated complexing agent which is free of phosphorous and at least one organic stabilising agent which comprises 1 to 5 phosphonate residues
wherein the concentration of the stabilising agent which comprises 1 to 5 phosphonate residues ranges from 0.1 to 100 mmol/l for stabilising agents comprising four and five phosphonate residues and from 50 to 500 mmol/l for stabilising agents comprising one, two and three phosphonate residues and c. depositing a layer of palladium and/or palladium alloy onto the metal surface of the substrate.

DETAILED DESCRIPTION OF THE INVENTION

The aqueous electroless palladium and/or palladium alloy plating bath according to the present invention contains a source of palladium ions which is a water soluble palladium compound such as palladium chloride, palladium nitrate, palladium acetate, palladium sulfate and palladium perchlorate. Optionally, a complex compound comprising a palladium ion and the nitrogenated complexing agent which is free of phosphorous can be added to the plating bath instead of forming such a complex compound in the plating bath by adding a palladium salt and said nitrogenated complexing agent which is free of phosphorous to the plating bath as separate ingredients. Palladium ions are added in a concentration from 0.5 to 500 mmol/l, preferably from 1 to 100 mmol/l.

The electroless palladium and/or palladium alloy plating bath further comprises a nitrogenated complexing agent which free of phosphorous. Said nitrogenated complexing agent is selected from the group comprising primary amines, secondary amines and tertiary amines which do not contain phosphorous. Suitable amines are for example ethylene-diamine, 1,3-diamino-propane, 1,2-bis(3-amino-propyl-amino)-ethane, 2-diethyl-amino-ethyl-amine, diethylene-triamine, diethylene-triamine-penta-acetic acid, nitro-acetic acid, N-(2-hydroxy-ethyl)ethylene-diamine, ethylene-diamine-N,N-diacetic acid, 2-(dimethyl-amino)-ethyl-amine, 1,2-diamino-propyl-amine, 1,3-diamino-propyl-amine, 3-(methyl-amino)propyl-amine, 3-(dimethyl-amino)-propyl-amine, 3-(diethyl-amino)-propyl-amine, bis-(3-amino-propyl)-amine, 1,2-bis-(3-amino-propyl)-alkyl-amine, diethylene-triamine, triethylene-tetramine, tetra-ethylene-pentamine, penta-ethylenehexamine and mixtures thereof.

The mole ratio of the complexing agent which is free of phosphorous and palladium ions in the electroless plating bath according to the present invention ranges from 2:1 to 50:1.

The electroless plating bath according to the present invention further comprises a reducing agent which makes the plating bath an autocatalytic, i.e. an electroless plating bath. Palladium ions are reduced to metallic palladium in the presence of said reducing agent.

The electroless plating bath is particularly suitable for depositing pure palladium layers in the presence of formic acid, a derivative or salt thereof. Suitable derivatives of formic acid are for example esters of formic acid, such as formic acid methylester, formic acid ethylester and formic acid propylester. Other suitable derivatives of formic acid are for example substituted and non-substituted amides such as formamide and N,N-dimethylformamide. Suitable counter ions for salts of formic acid are for example selected from hydrogen, lithium, sodium, potassium and ammonium.

Suitable reducing agents for deposition of palladium alloys are for example hypophosphite compounds such as sodium hypophosphite and potassium hypophosphite which form palladium phosphorous alloys and amine-borane adducts such as dimethyl amine borane which form palladium boron alloys. The concentration range of such reducing agents in an electroless palladium plating bath is the same as in case of formic acid, derivatives and salts thereof.

The reducing agent is added to the electroless plating bath in a concentration of 10 to 1000 mmol/l.

A pure palladium layer according to the present invention is a layer comprising a palladium content of more than 99.0 wt.-%, preferred more than 99.5 wt.-% palladium or even more preferred more than 99.9 wt.-% or more than 99.99 wt.-% palladium.

In another embodiment of the present invention, the palladium plated layer is an alloy layer which comprises 90 to 99.9 wt.-% of palladium, and 0.1 to 10.0 wt.-% of phosphorus or boron more preferred 93 to 99.5 wt.-% of palladium and 0.5 to 7 wt.-% of phosphorous or boron.

The plating bath composition according to the present invention further comprises at least one organic stabilising agent which comprises 1 to 5 phosphonate residues.

Preferably, the at least one organic stabilising agent which comprises 1 to 5 phosphonate residues is selected from compounds according to formula (1)

(1)

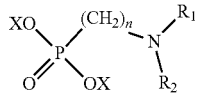

wherein

R1 is selected from the group consisting of (2a)

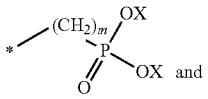

and (2b)

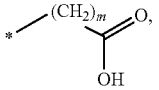

hydrogen, methyl, ethyl, propyl and butyl;

R2 is selected from the group consisting of (2a)

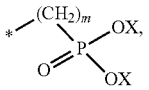

(2b)

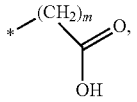

(2c)

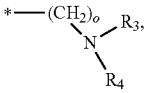

hydrogen, methyl, ethyl, propyl and butyl;

R3 is selected from the group consisting of (2a)

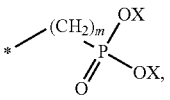

-continued (2b)

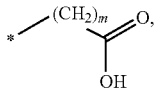

hydrogen, methyl, ethyl, propyl and butyl;

R4 is selected from the group consisting of (2a)

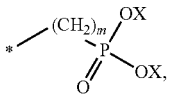

(2d)

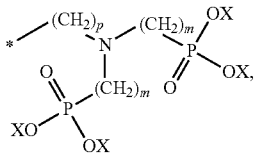

hydrogen, methyl, ethyl, propyl and butyl;

n is an integer and ranges from 1 to 6; m is an integer and ranges from 1 to 6; o is an integer and ranges from 1 to 6; p is an integer and ranges from 1 to 6 and X is selected from the group consisting of hydrogen and a suitable counter ion. Suitable counter ions are lithium, sodium, potassium and ammonium.

More preferably, R1 and R3 are (2a)

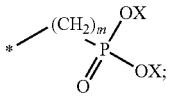

(2c)

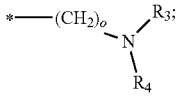

R2 is and

R4 is (2d)

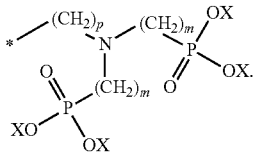

Preferably, n, m, o and p independently are selected from 1 and 2. More preferably, n, m are 1; and o and p are 2.

The concentration of the at least one organic stabilising agent which comprises 1 to 5 phosphonate residues depends on the number of phosphonate groups in the organic stabilising agent:

The concentration of the at least one organic stabilising agent ranges from 0.1 to 100 mmol/l for stabilising agents comprising 4 and 5 phosphonate residues and from 50 to 500 mmol/l for stabilising agents comprising 1, 2 and 3 phosphonate residues.

The pH value of the electroless plating bath ranges from 4 to 7 because the plating bath is unstable at a pH value below 4. Preferably, the pH value of the plating bath ranges from 5 to 6.

The deposition rate of an electroless palladium plating bath which does not comprise an organic stabilising agent comprising 1 to 5 phosphonate residues reaches zero in presence of 5 ppm copper ions (comparative example 1). Such plating bath compositions are disclosed in U.S. Pat. No. 5,882,736.

The deposition rate of an electroless palladium plating bath which contains an organic stabilising agent comprising 1 to 5 phosphonate residues in a too high amount and which does not contain a nitrogenated complexing agent free of phosphorous is zero without added impurities of copper ions as well as in the presence of 5 ppm copper ions (comparative example 2).

The deposition rate of an electroless palladium plating bath which contains an organic stabilising agent which comprises 1 to 5 phosphonate residues in a too high amount and a nitrogenated complexing agent which is free of phosphorous is already zero without copper ions present (comparative examples 3 and 4).

The deposition rate of an electroless palladium plating bath which contains an organic stabilising agent which comprises 1 to 5 phosphonate residues in a too low amount and a nitrogenated complexing agent which is free of phosphorous becomes zero in the presence of 5 ppm copper ions (comparative example 5).

An electroless palladium plating bath according to the present invention maintains a sufficient plating rate in the presence of 5 ppm or more of copper ions in the plating bath (examples 6 to 10).

Deposition of palladium is preferably carried out by contacting a substrate having a metal surface in the electroless plating bath according to the present invention. The metal surface to be coated with palladium or a palladium alloy is selected from the group comprising copper, copper alloys, nickel and nickel alloys. The metal surface to be coated is for example part of a printed circuit board, an IC substrate or a semiconducting wafer.

Suitable methods for contacting the substrate with the electroless plating bath are dipping (vertical equipment) or spraying (horizontal equipment).

The palladium or palladium alloy plating process is conducted at about 35 to 95° C. for 1 to 60 min to give a palladium or palladium alloy plated layer ranging in thickness from 0.01 to 5.0 μm, more preferred from 0.02 to 1.0 μm and even more preferred 0.05 to 0.5 μm.

In one embodiment of the present invention, a thin activation layer of palladium is first deposited onto the metal surface by an immersion-type plating method (exchange reaction) followed by palladium or palladium alloy deposition from the electroless plating bath according to the present invention.

Activation methods for the metal surface prior to electroless palladium or palladium alloy deposition are known in the art and can be applied to work the present invention. A suitable aqueous activation bath may comprise a palladium salt such as palladium acetate, palladium sulfate and palladium nitrate, a complexing agent such as primary amines, secondary amines, tertiary amines and ethanolamines and an acid such as nitric acid, sulfuric acid and methane sulfonic acid. Optionally, such an activation bath further contains an oxidizing agent such as nitrate ions, perchlorate ions, chlorate ions, perborate ions, periodate ions, peroxo-disulfate ions and peroxide ions.

The concentration of the palladium salt in the aqueous activation bath ranges from 0.005 to 20 g/l, preferably from 0.05 to 2.0 g/l. The concentration of the complexing agent ranges from 0.01 to 80 g/l, preferably from 0.1 to 8 g/l.

The pH value of the aqueous activation bath ranges from 0 to 5, preferably from 1 to 4.

Typically, the substrates are immersed in the aqueous activation bath at 25 to 30° C. for one to four minutes. Prior to immersing the substrate in an aqueous activation bath, the metal surface of the substrate is cleaned. For this purpose, etch cleaning is usually carried out in oxidizing, acidic solutions, for example a solution of sulfuric acid and hydrogen peroxide. Preferably, this is followed by another cleaning in an acidic solution, such as, for example, a sulfuric acid solution.

The present invention is further explained by the following non-limiting examples.

EXAMPLES

General Procedure

Coupons comprising a copper surface (50×50 mm) were used as substrate throughout all examples. The coupons were activated by immersion-type plating of palladium in an aqueous solution of palladium acetate, sulphuric acid and a complexing agent (pH value=2.5), followed by rinsing with water.

In all examples 10 mmol/l palladium ions and 500 mmol/l sodium formate as reducing agent were used in the electroless palladium plating bath compositions. The nitrogenated complexing agent which does not contain phosphorous is in all cases ethylene diamine. The plating bath pH value was in all experiments adjusted to 5.5.

sulfate in order to simulate a palladium electrolyte during use in the manufacture of electronic components such as printed circuit boards and IC substrates. The thickness of the palladium layer after 5 min immersion in various electroless palladium plating bath compositions tested was again determined by X-ray fluorescence measurements.

The electroless plating bath compositions and plating results after 5 min with and without 5 ppm of copper ions are summarised in Table 1.

No palladium is deposited from the plating bath according to comparative example 1 after addition of 5 ppm copper ions to the plating bath.

No palladium is deposited from the plating bath compositions according to comparative examples 2 to 4 even without copper ions.

No palladium is deposited from the plating bath composition according to comparative example 5 in the presence of 5 ppm copper ions.

The plating rate is maintained in the presence of 5 ppm copper ions in case of examples 6 to 10 which are in accordance with the present invention.

Abbreviations for organic stabilising agents containing 1 to 5 phosphonate groups used in the examples:

| Acronym | Name | No. of phosphonate groups |
|---|---|---|
| PBTC | 2-Butane phosphonate 1,2,4-tricarboxylic acid | 1 |
| PMIDA | N-(phosphonomethyl) imidodiacetic acid | 1 |
| NTPA | Nitrilotris(methylene phosphonic acid) | 3 |
| EDTPA | Ethane-1,2-bis(iminobis(methylene-phosphonic acid)) | 4 |
| DTPPA | Diethylenetriamine-N,N,N',N'',N''-penta(methylphosphonic acid) | 5 |

TABLE 1 plating bath compositions and palladium layer thicknesses after 5 min plating with and without 5 ppm copper ions:

| | Example | | | | | | | | | |
|---|---|---|---|---|---|---|---|---|---|---|
| | 1 | 2 | 3 | 4 | 5 | 6 | 7 | 8 | 9 | 10 |
| complexing agent* | 50 mmol/l | none | 50 mmol/l | 50 mmol/l | 50 mmol/l | 50 mmol/l | 50mmol/l | 50 mmol/l | 50 mmol/l | 50 mmol/l |
| stabilising agent** | none | EDTPA 50 mmol/l | DTPPA 150 mmol/l | EDTPA 150 mmol/l | NTPA 25 mmol/l | PBTC 200 mmol/l | PMIDA 200 mmol/l | NTPA 100 mmol/l | EDTPA 25 mmol/l | DTPPA 5 mmol/l |
| No. of phosphonate groups | none | 4 | 5 | 4 | 3 | 1 | 1 | 3 | 4 | 5 |
| Pd layer thickness w/o $Cu^{2+}$ | 0.2 μm | 0 | 0 | 0 | 0.19 μm | 0.22 μm | 0.22 μm | 0.22 μm | 0.22 μm | 0.22 μm |
| Pd layer thickness w. 5 ppm $Cu^{2+}$ | 0 | 0 | 0 | 0 | 0 | 0.21 μm | 0.21 μm | 0.23 μm | 0.23 μm | 0.21 μm |
| reference | U.S. Pat. No. 5,882,736 | Comparative | Comparative | Comparative | Comparative | Present invention | Present invention | Present invention | Present invention | Present invention |

*= nitrogenated complexing agent free of phosphorous

**= organic stabilising agent with 1 to 5 phosphonate groups

The thickness of the palladium layer after 5 min immersion in various electroless palladium plating bath compositions tested was determined with an X-ray fluorescence method (XRF; Fischer, Fischerscope® X-Ray XDV®-μ). The temperature of the electroless plating baths during palladium deposition was held at 52° C. in all examples.

An amount of 5 ppm copper ions was added to the electroless palladium plating bath compositions in form of copper

The invention claimed is:

1. An aqueous plating bath for electroless deposition of palladium and/or palladium alloys onto a copper or copper alloy surface, the plating bath comprising a. a source of palladium ions b. at least one nitrogenated complexing agent which is free of phosphorous c. a reducing agent selected from formic acid, formic acid derivatives, salts and mixtures of the aforementioned, hypophosphite compounds and amine-borane adducts and d. at least one organic stabilising agent which comprises 1 to 5 phosphonate residues wherein the concentration of the stabilising agent which comprises 1 to 5 phosphonate residues ranges from 0.1 to 100 mmol/l for stabilising agents comprising four and five phosphonate residues and from 50 to 500 mmol/l for stabilising agents comprising one, two and three phosphonate residues and wherein the at least one organic stabilising agent is selected from compounds according to formula (1)

(1)

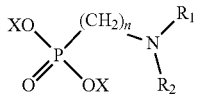

wherein

R1 is selected from the group consisting of (2a)

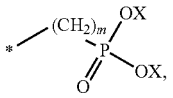

(2b)

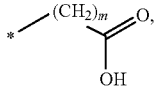

hydrogen, methyl, ethyl, propyl and butyl;

R2 is selected from the group consisting of (2a)

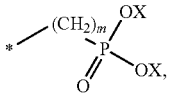

(2b)

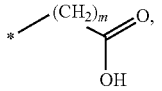

(2c)

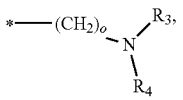

hydrogen, methyl, ethyl, propyl and butyl;

R3 is selected from the group consisting of (2a)

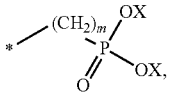

-continued (2b)

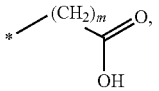

hydrogen, methyl, ethyl, propyl and butyl;

R4 is selected from the group consisting of (2a)

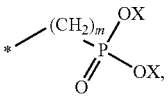

(2d)

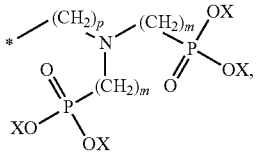

hydrogen, methyl, ethyl, propyl and butyl;

n is an integer and ranges from 1 to 6; m is an integer and ranges from 1 to 6; o is an integer and ranges from 1 to 6; p is an integer and ranges from 1 to 6 and X is selected from the group consisting of hydrogen and a suitable counter ion.

2. The aqueous plating bath according to claim 1 wherein X is selected from the group consisting of hydrogen, lithium, sodium, potassium and ammonium.

3. The aqueous plating bath according to claim 1 wherein n, m, o and p are independently selected from 1 and 2.

4. The aqueous plating bath according to claim 1 wherein n and m are 1 and o and p are 2.

5. The aqueous plating bath according to claim 1 wherein the stabilising agent is selected from compounds according to formula (1) with R1 and R3 selected from formula (2a), R2 selected from formula (2c) and R4 selected from formula (2d).

6. The aqueous plating bath according to claim 1 wherein the source of palladium ions is selected from palladium chloride, palladium nitrate, palladium acetate, palladium sulfate, palladium perchlorate and complex compounds comprising at least one palladium ion and at least one nitrogenated complexing agent which is free of phosphorous.

7. The aqueous plating bath according to claim 1 wherein the concentration of palladium ions ranges from 0.5 to 500 mmol/l.

8. The aqueous plating bath according to claim 1 wherein the nitrogenated complexing agent which is free of phosphorous is selected from primary amines, secondary amines and ternary amines.

9. The aqueous plating bath according to claim 1 wherein the mole ratio of nitrogenated complexing agent which is free of phosphorous and palladium ions ranges from 2:1 to 50:1.

10. The aqueous plating bath according to claim 1 wherein the concentration of the reducing agent ranges from 10 to 1000 mmol/l.

11. The aqueous plating bath according to claim 1 having a pH value in the range of 4 to 7.

12. The aqueous plating bath according to claim 3 wherein the stabilising agent is selected from compounds according to formula (1) with R1 and R3 selected from formula (2a), R2 selected from formula (2c) and R4 selected from formula (2d).

13. The aqueous plating bath according to claim 4 wherein the stabilising agent is selected from compounds according to formula (1) with R1 and R3 selected from formula (2a), R2 selected from formula (2c) and R4 selected from formula (2d).

14. The aqueous plating bath according to claim 1 wherein the hypophosphite compound is selected from sodium hypophosphite and potassium hypophosphite.

15. The aqueous plating bath according to claim 1 wherein the amine-borane adduct is dimethyl amine borane.

16. A method for electroless deposition of palladium or a palladium alloy onto a copper or copper alloy surface, the method comprising the steps of a. providing a substrate having a metal surface, b. providing an aqueous palladium or palladium alloy plating bath composition comprising a source of palladium ions, a reducing agent selected from formic acid, formic acid derivatives, salts and mixtures of the aforementioned, hypophosphite compounds and amine-borane adducts, a nitrogenated complexing agent which is free of phosphorous and at least one organic stabilising agent which comprises 1 to 5 phosphonate residues wherein the concentration of the stabilising agent which comprises 1 to 5 phosphonate residues ranges from 0.1 to 100 mmol/l for stabilising agents comprising four and five phosphonate residues and from 50 to 500 mmol/l for stabilising agents comprising one, two and three phosphonate residues and c. depositing a layer of palladium or a palladium alloy onto the metal surface of the substrate from the palladium or palladium alloy plating bath from step b.

17. A method according to claim 16 wherein the method further comprises deposition of palladium by immersion-type plating onto the metal surface prior to step c.

18. The method according to claim 16 wherein the hypophosphite compound is selected from sodium hypophosphite and potassium hypophosphite.

19. The method according to claim 16 wherein the amine-borane adduct is dimethyl amine borane.

* * * * *